US005931427A

United States Patent [19]

Pan

[11] Patent Number: 5,931,427

[45] Date of Patent: Aug. 3, 1999

[54] BATHROOM RACK

[76] Inventor: Chin-Cheng Pan, No. 99, Sec. 3, Chang Tsao Rd., Ho Me, Changhua, Taiwan

[21] Appl. No.: 08/998,683

[22] Filed: Dec. 29, 1997

[30] Foreign Application Priority Data

Feb. 4, 1997 [TW] Taiwan ..... 86202083

[51] Int. Cl.[6] ..... G01N 9/04

[52] U.S. Cl. ..... 248/224.7; 248/251; 248/225.11; 248/223.41; 211/16

[58] Field of Search ..... 248/224.7, 223.31, 248/225.11, 223.41, 224.51, 251, 201; 211/123, 16; 4/559, 576.1, 577.1; 242/570; D6/524, 546, 547, 548, 549

[56] References Cited

U.S. PATENT DOCUMENTS

| | | | |
|---|---|---|---|
| 261,817 | 7/1882 | Mallory | 211/16 |
| 320,211 | 6/1885 | Bergsten | 211/16 |
| 603,870 | 5/1898 | Boland | 160/339 |
| 1,800,030 | 4/1931 | Reynolds | 211/123 |
| 5,810,180 | 9/1998 | Chan | 211/117 |

*Primary Examiner*—Ramon O. Ramirez
*Assistant Examiner*—Gwendolyn Baxter
*Attorney, Agent, or Firm*—W. Wayne Liauh

[57] ABSTRACT

A bathroom rack is composed of at least one U-shaped fastening piece, two connection heads, and one block body which is held by the U-shaped fastening piece. Two arms of the U-shaped fastening piece are held by the connection heads which are fastened onto the bathroom wall. The block body is versatile in form and is held by the fastening piece such that the bathroom rack may be used for various purposes.

9 Claims, 18 Drawing Sheets

BATHROOM RACK

FIELD OF THE INVENTION

The present invention relates generally to a bathroom accessory, and more particularly to a bathroom rack for holding towels, washcloth and the like.

BACKGROUND OF THE INVENTION

As shown in FIGS. 1A, 1B, 1C, 1D, 1E and 1F, a towel rack of the prior art is composed of two fastening pieces 10 and a rod 13 held between the two fastening pieces 10 which are fastened securely to the bathroom wall by means of a plurality of screws 11 which are concealed by a cover 12.

As shown in FIG. 1B, a bathrobe rack of the prior art is composed of a fastening piece 20, which is fastened onto the bathroom wall by a plurality of bolts 21 which are concealed by a cover 22. Another prior art bathroom rack is shown in FIG. 1C and is composed of two fastening pieces 30, which are fastened onto the bathroom wall by a plurality of bolts 31, which are concealed by a cover 32. A shelf 33 is supported by the fastening pieces 32 for holding various articles. The shelf 33 is securely located by means of two fastening bolts 34. As shown in FIG. 1D, a prior art toilet paper rack is composed of a fastening piece 40, which is fastened onto the bathroom wall by means of bolts 41 which are concealed by a cover 42. A hook ring 43 is fastened with the fastening piece. Similar prior art racks are shown in FIGS. 1E and 1F, and are composed of fastening pieces 50, 60, bolts 51, 61, covers 52, 62, and the ring 53.

Such prior art bathroom racks as described above are defective in design in that the fastening pieces of the prior art racks are varied in form, thereby resulting in an increase in the cost of making various molding tools for the production of the fastening pieces of the prior art bathroom racks.

SUMMARY OF THE INVENTION

The primary objective of the present invention is to provide a bathroom rack which is simple in construction and is free from the drawbacks of the prior art bathroom racks.

In keeping with the principle of the present invention, the foregoing objective of the present invention is attained by a bathroom rack consisting of at least one U-shaped fastening piece and at least one block body held by the U-shaped fastening piece. Both arms of the U-shaped fastening piece are fastened with the bathroom wall. The block body is versatile in form such that the bathroom rack can be used for various purposes.

The objective and the features of the present invention will be more readily understood upon a thoughtful deliberation of the following detailed description of the present invention with reference to the accompanying drawings.

DETAILED DESCRIPTION OF THE INVENTION

Figure 1A:
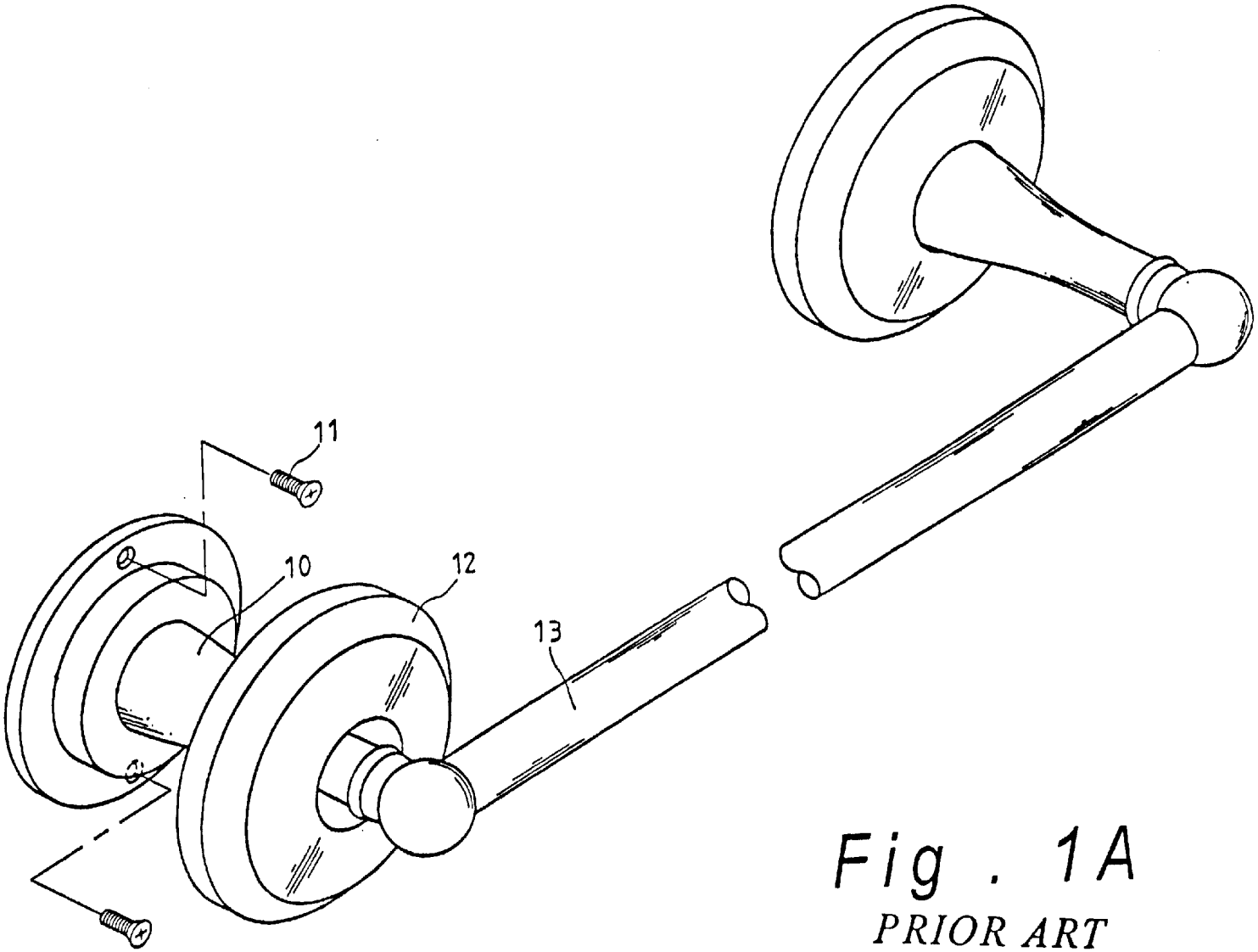
Fig. 1A PRIOR ART
FIG. 1A shows a schematic view of a towel rack of the prior art.
Figure 1B:
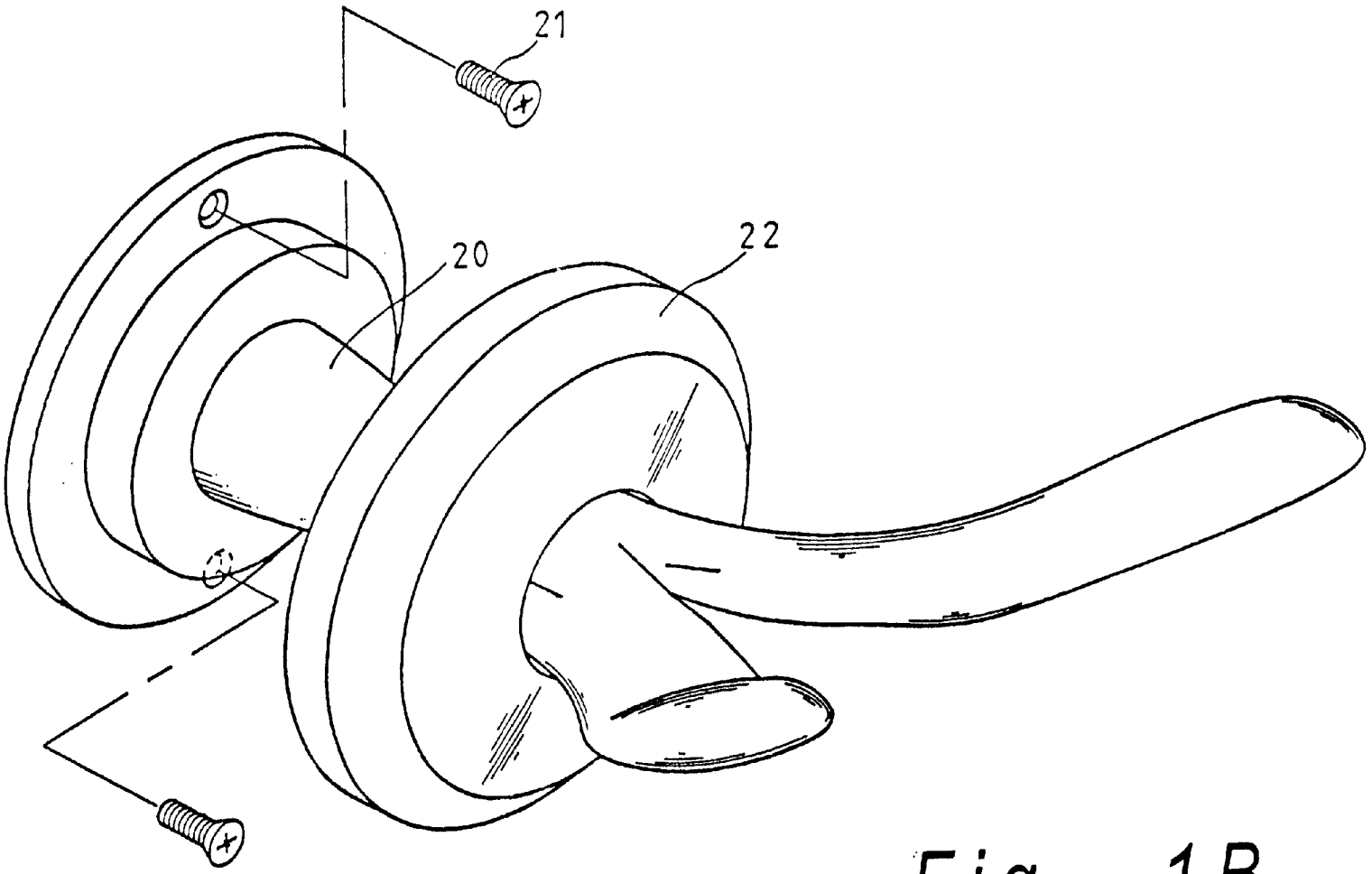
Fig. 1B PRIOR ART
FIG. 1B shows a schematic view of a bathrobe hanger of the prior art.
Figure 1C:
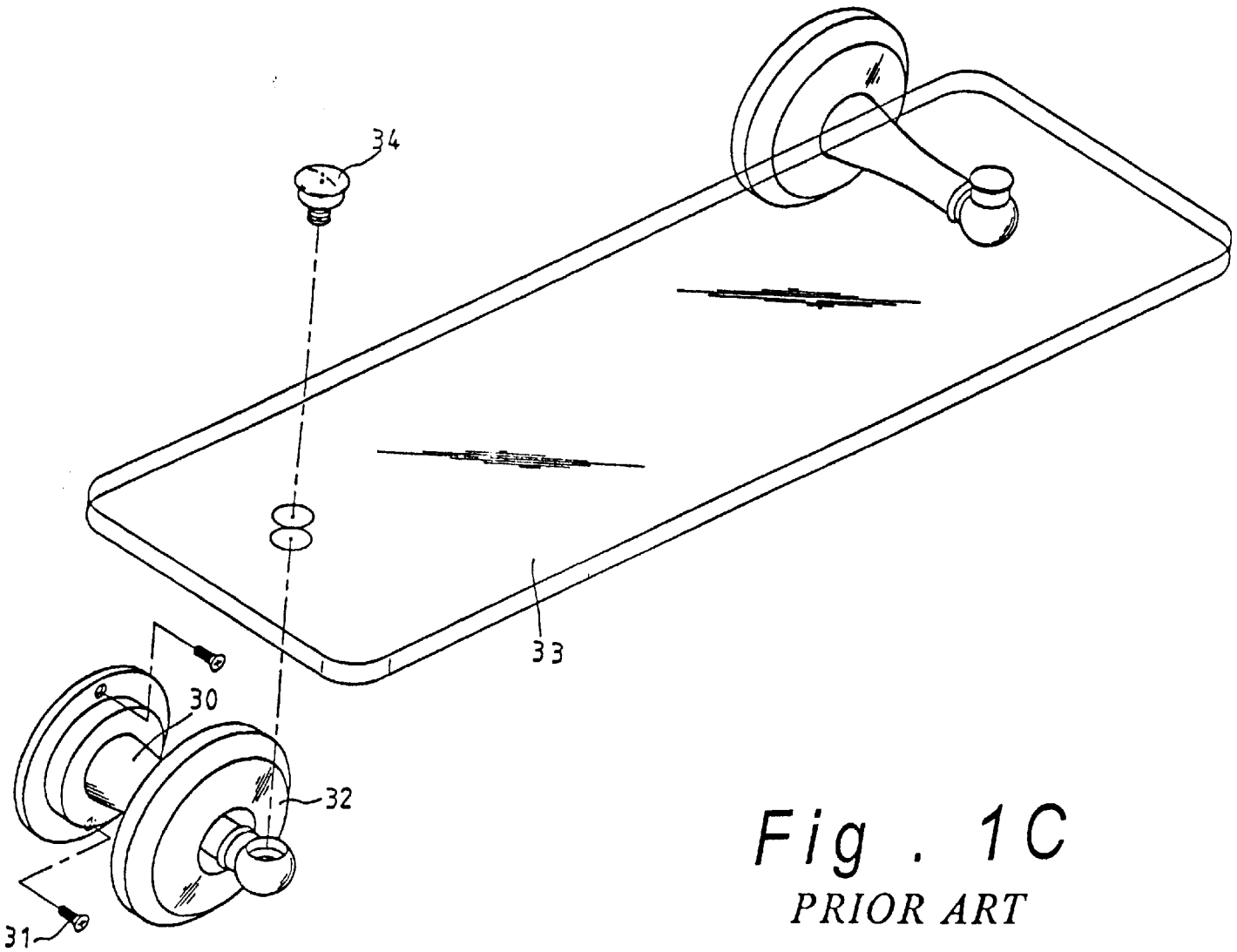
Fig. 1C PRIOR ART
FIG. 1C shows a schematic view of a bathrobe rack of the prior art.
Figure 1D:
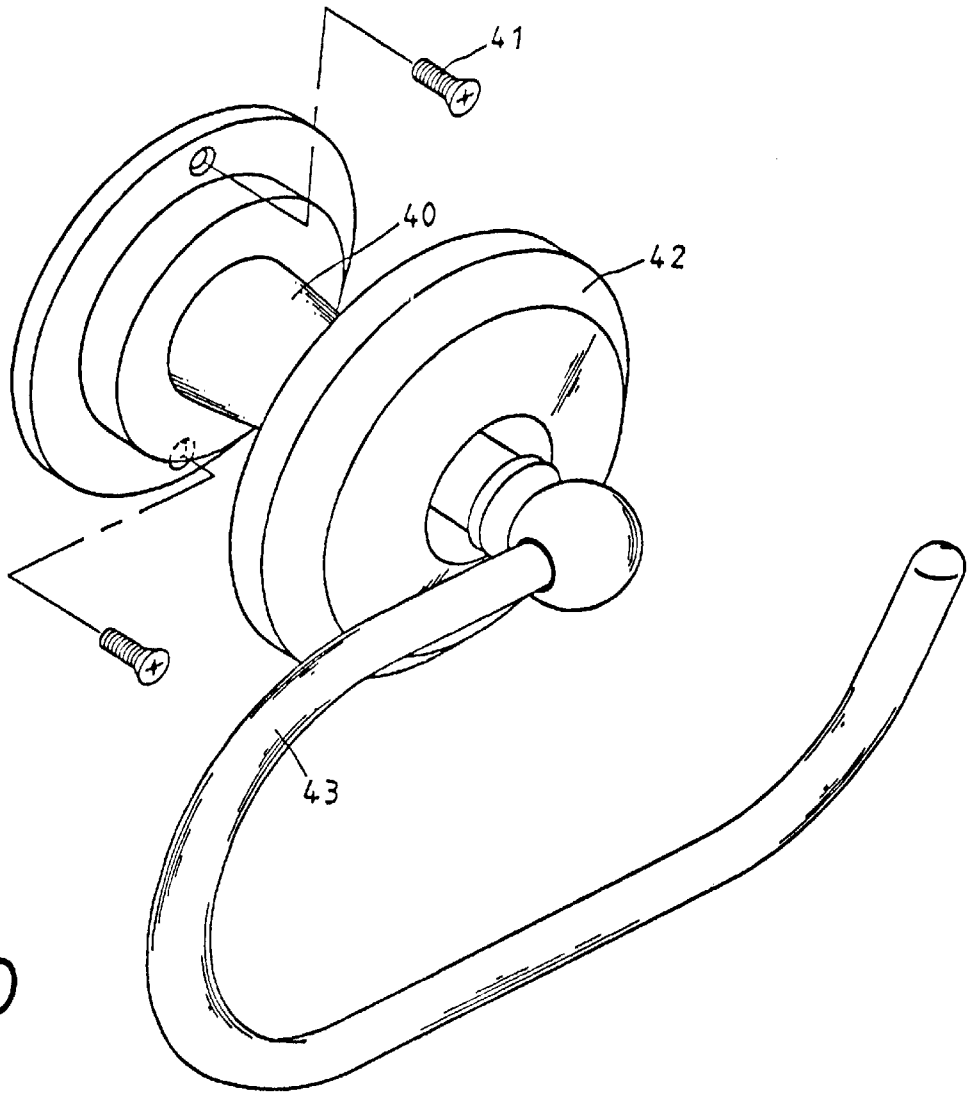
Fig. 1D PRIOR ART
FIG. 1D shows a schematic view of a toilet paper rack of the prior art.
Figure 1E:
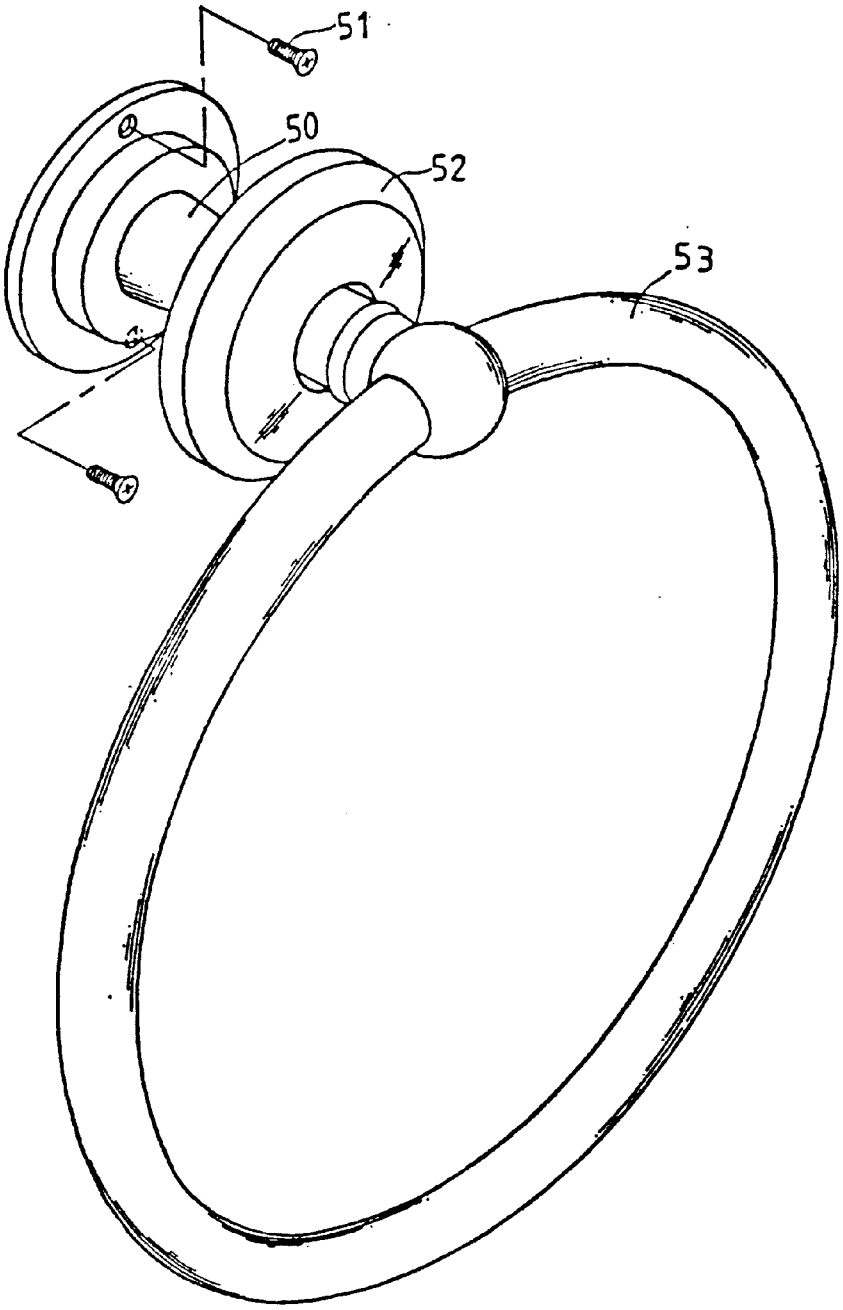
Fig. 1E PRIOR ART
FIG. 1E shows a schematic view of a wiping cloth rack of the prior art.
Figure 1F:
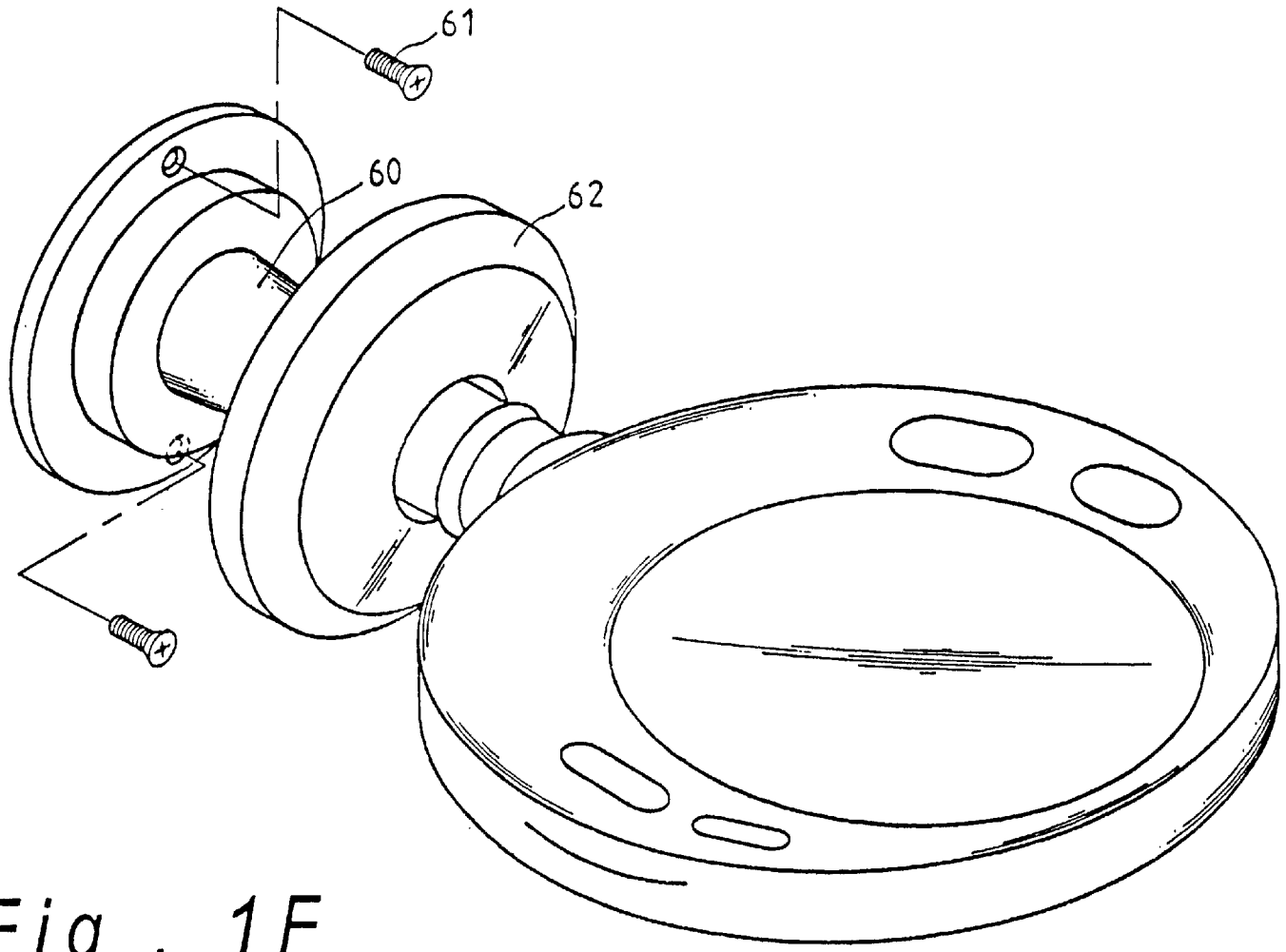
Fig. 1F PRIOR ART
FIG. 1F shows a schematic view of a cup rack of the prior art.
Figure 2A:
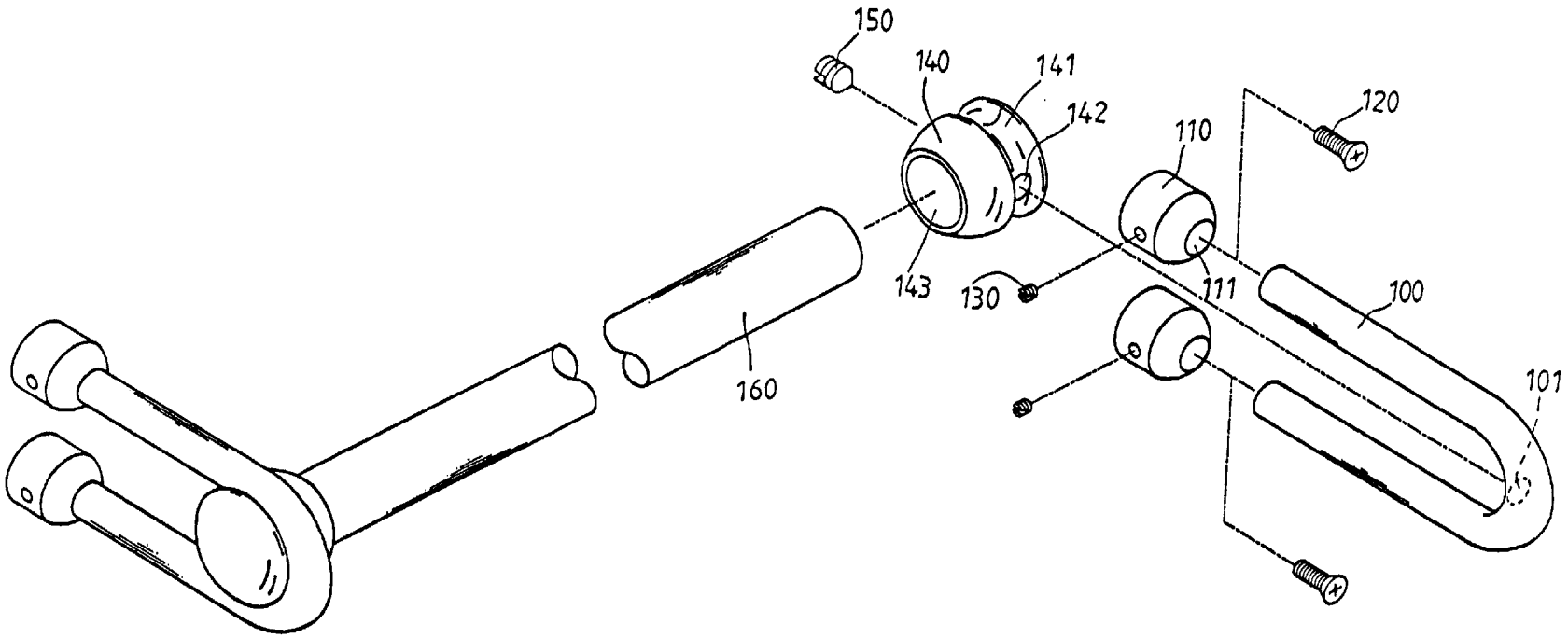
FIG. 2A shows an exploded view of a towel rack of the present invention.
Figure 2B:
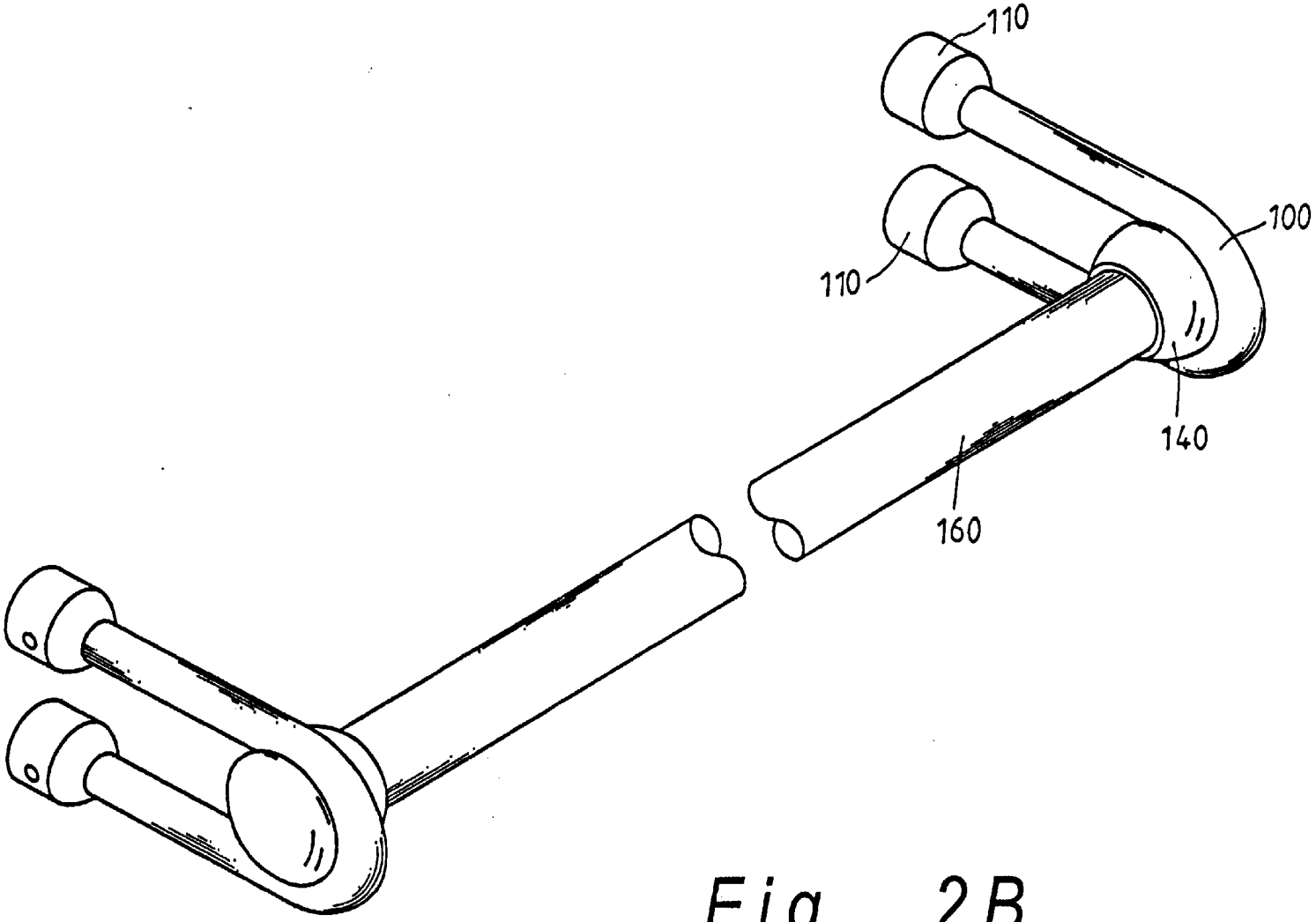
FIG. 2B shows a schematic view of the towel rack of the present invention in combination.
Figure 3A:
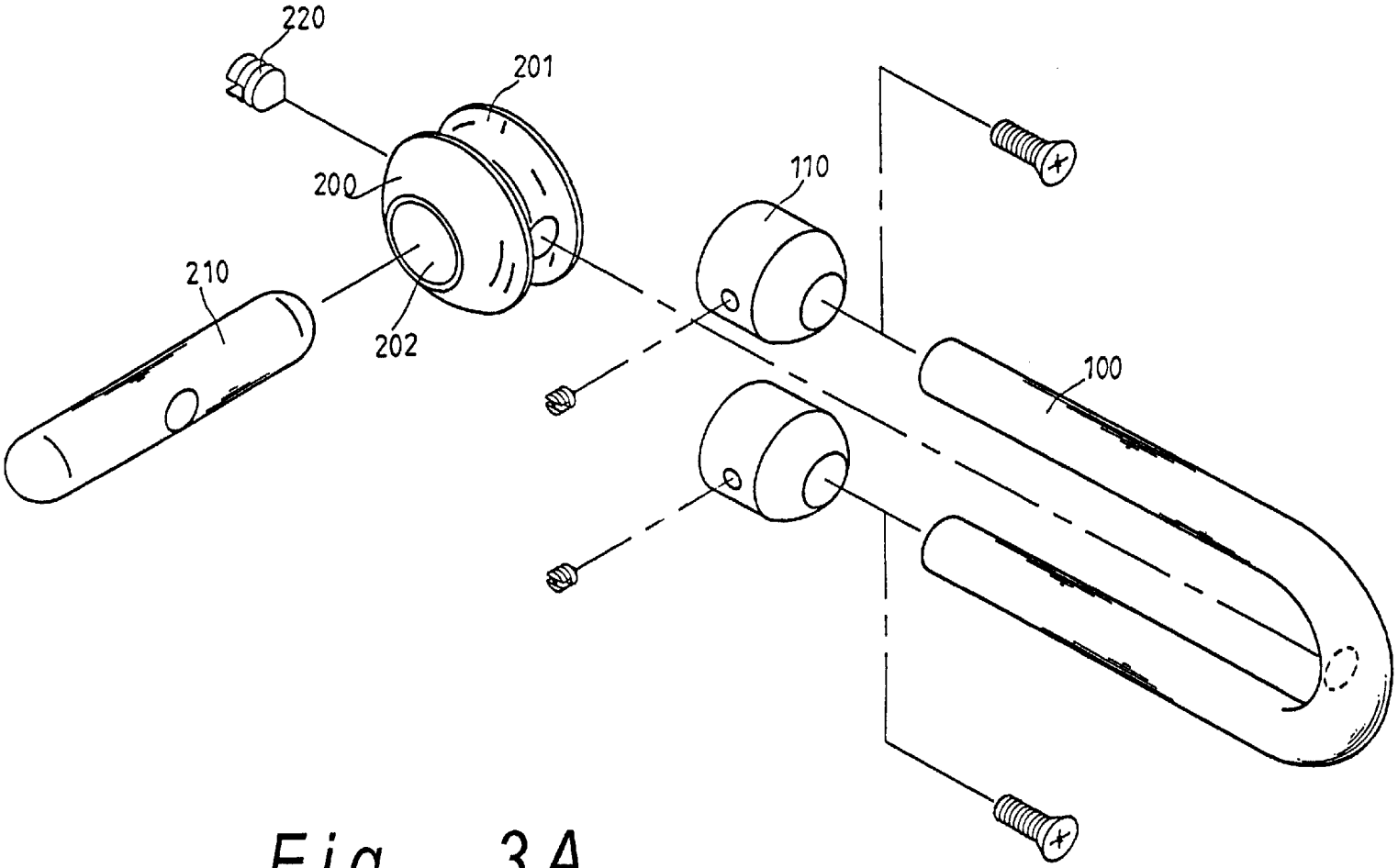
FIG. 3A shows an exploded view of a bathrobe rack of the present invention.
Figure 3B:
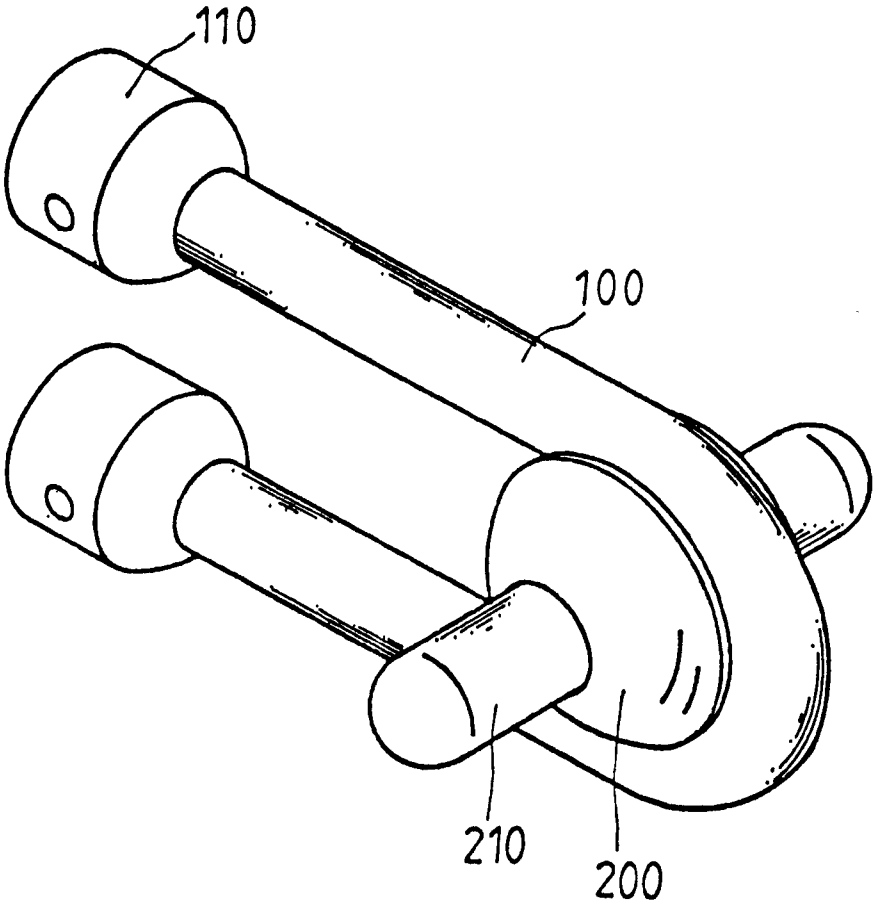
FIG. 3B shows a schematic view of the bathrobe rack of the present invention.
Figure 4A:
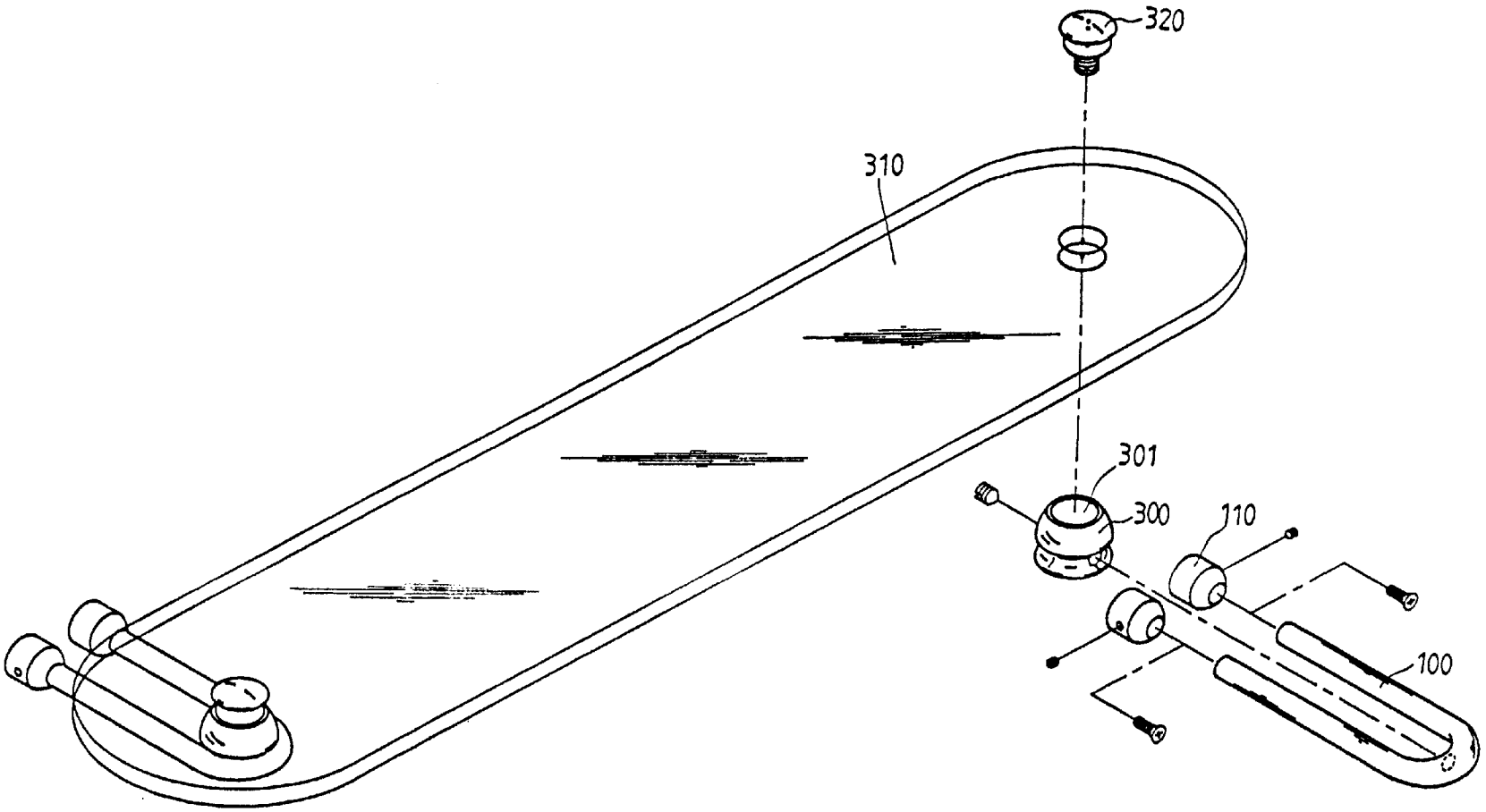
FIG. 4A shows another exploded view of a bathrobe rack of the present invention.
Figure 4B:
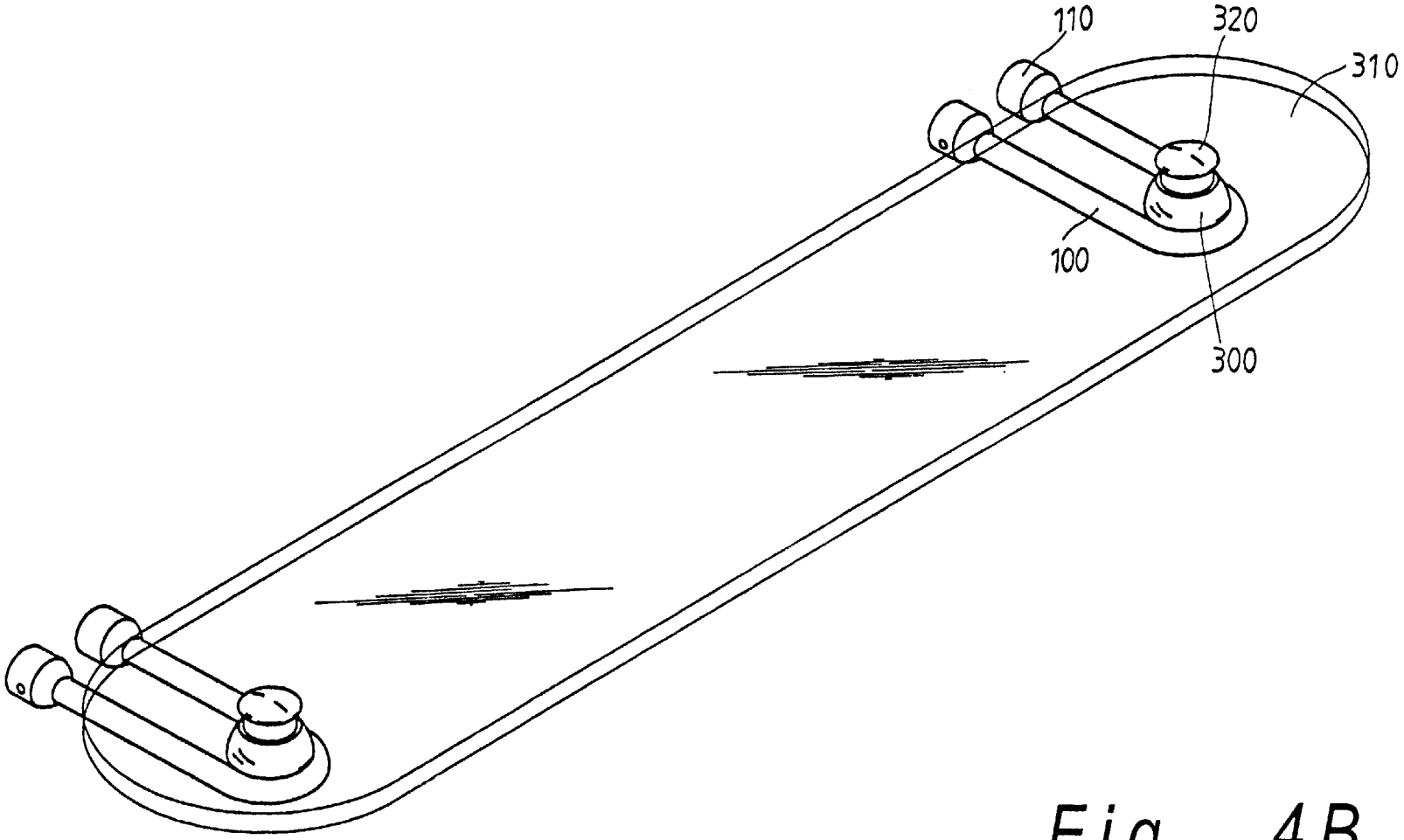
FIG. 4B shows a schematic view of the bathrobe rack in combination as shown in FIG. 4A.
Figure 5A:
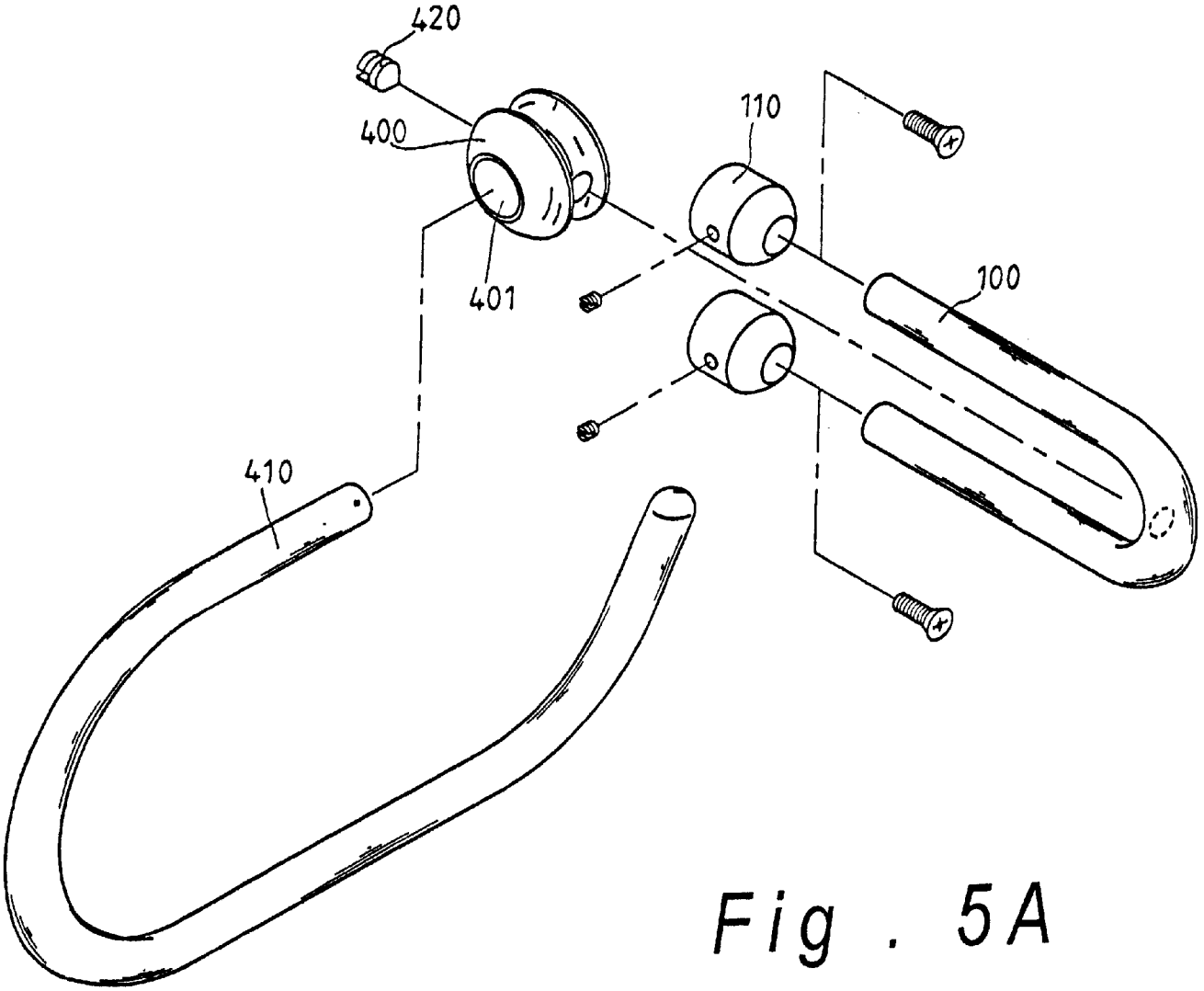
FIG. 5A shows an exploded view of a toilet paper rack of the present invention.
Figure 5B:
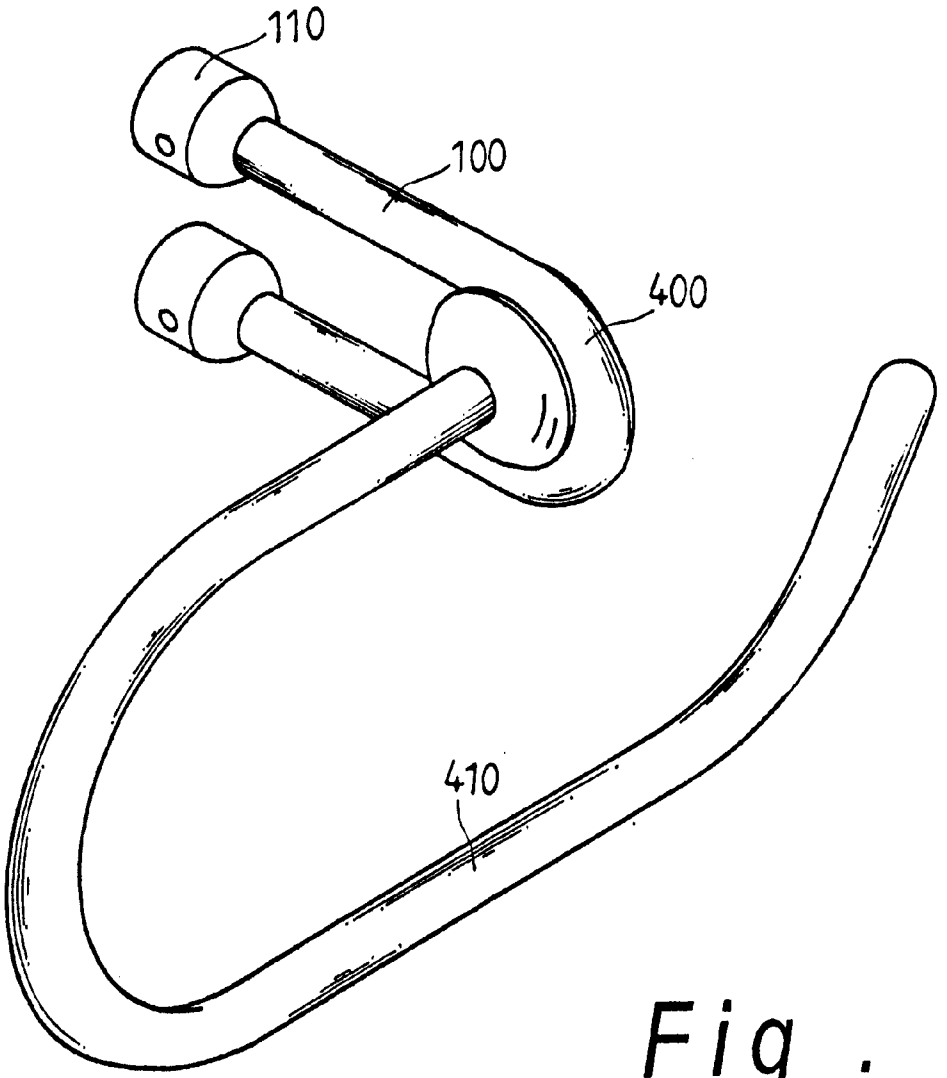
FIG. 5B shows a schematic view of the toilet paper rack of the present invention in combination.
Figure 6A:
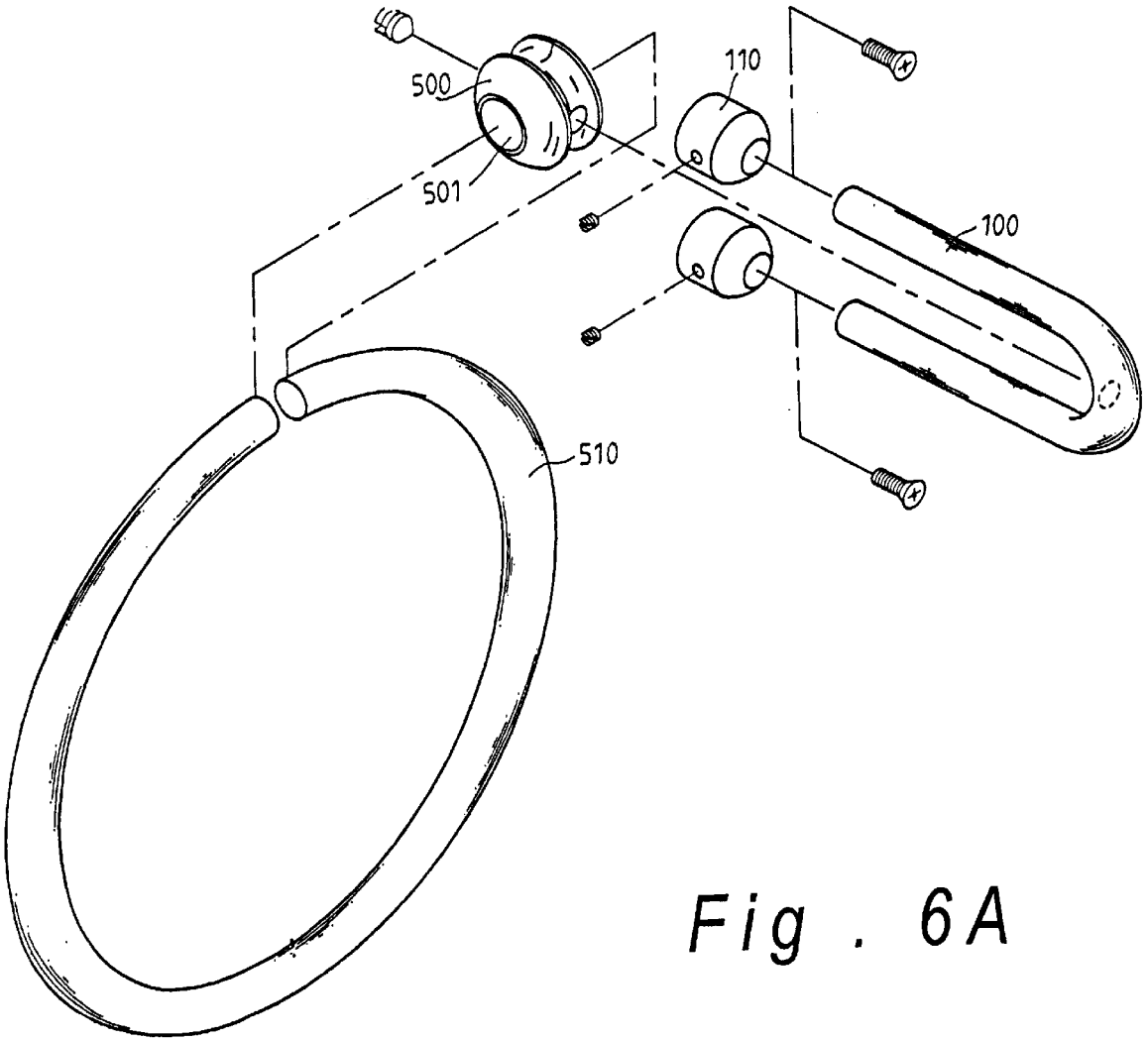
FIG. 6A shows an exploded view of a wiping cloth rack of the present invention.
Figure 6B:
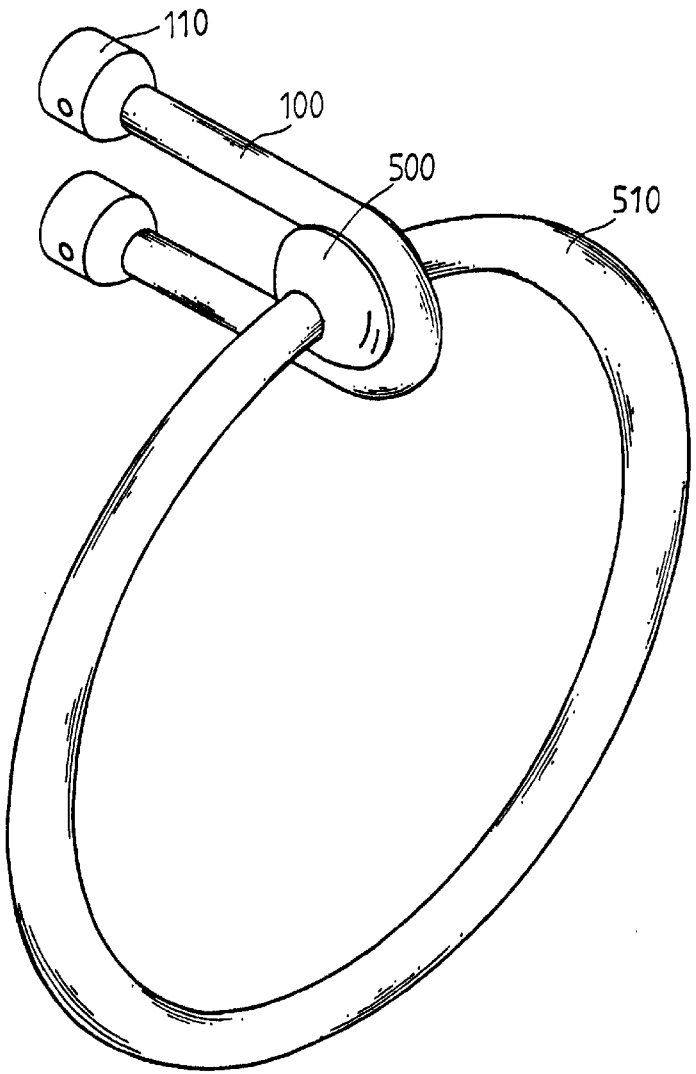
FIG. 6B shows a schematic view of the wiping cloth rack of the present invention in combination.

As shown in all drawings provided herewith, various bathroom racks of the present invention are basically composed of one or two U-shaped fastening pieces 100, which are fastened onto the bathroom wall in conjunction with two or more connection heads 110. Each of the connection heads 110 is provided with a stepped through hole 111 into which the arm of the fastening piece 100 is affixed by a screw 130. The connection head 110 is fastened onto the wall by a bolt 120. A block body (i.e., a short flanged cylinder) 140 is provided with a slot 141 which is engaged with the end of the arm of the fastening piece 100. The slot 141 is provided with a threaded hole 142 which is engaged with a bolt 150 which is in turn engaged with a threaded hole 101 of the fastening piece 100. The block body 140 is provided with a fitting hole 143 for engaging a bar 160. The rack shown in FIG. 2 is a towel rack. The rack shown in FIG. 3 is a bathrobe rack consisting of one fastening piece 100, which is fastened onto the bathroom wall in conjunction with two connection heads 110. A block body 200 is provided with a slot 201 and a through hole 202 into which a short rod 210 is inserted. The short rod 210, the block body 200 and the U-shaped fastening piece 100 are fastened together by a screw 220. Another bathroom rack of the present invention is shown in FIG. 4 and is composed of two U-shaped fastening pieces 100 and a shelf 310. The fastening pieces 100 are attached to the bathroom wall in conjunction with two block bodies 300 each having a threaded hole 301 which is engaged with a bolt 320 for securing the shelf 310. A toilet paper rack of the present invention is shown in FIGS. 5 and is composed of one U-shaped fastening piece 100, two connection heads 110, and a block body 400 provided with a fitting hole 401 for holding a ring 410 which is securely fastened with the block body 400 by a screw 420 for holding the toilet paper. A rack of the present invention for holding a wiping cloth is shown in FIGS. 6 and is composed of one U-shaped fastening piece 100, two connection heads 110, one block body 500, and a ring 510. The block body 500 is provided with a through hole 501 for holding the ring 510.

Figure 7A:
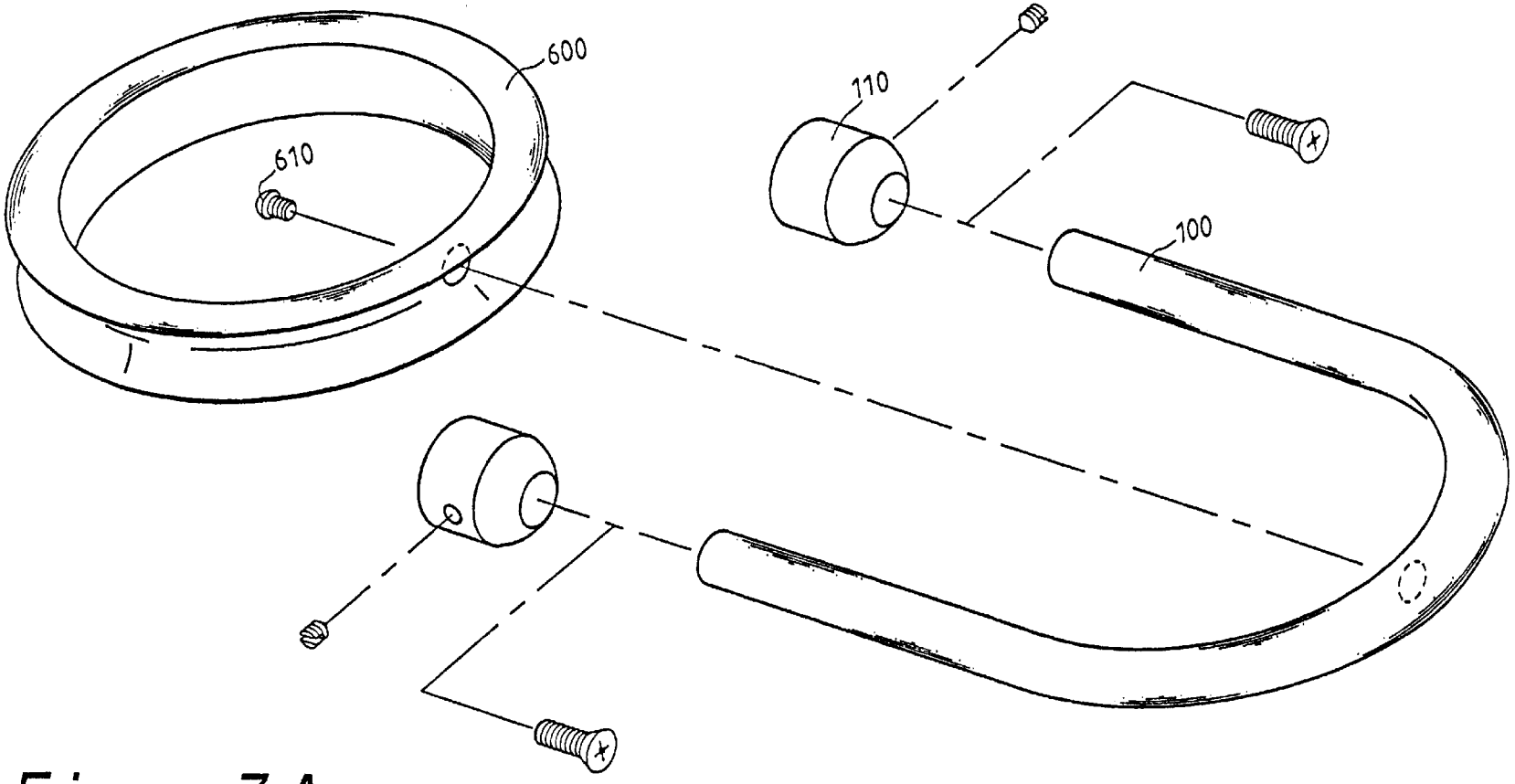
FIG. 7A shows an exploded view of a cup rack of the present invention.
Figure 7B:
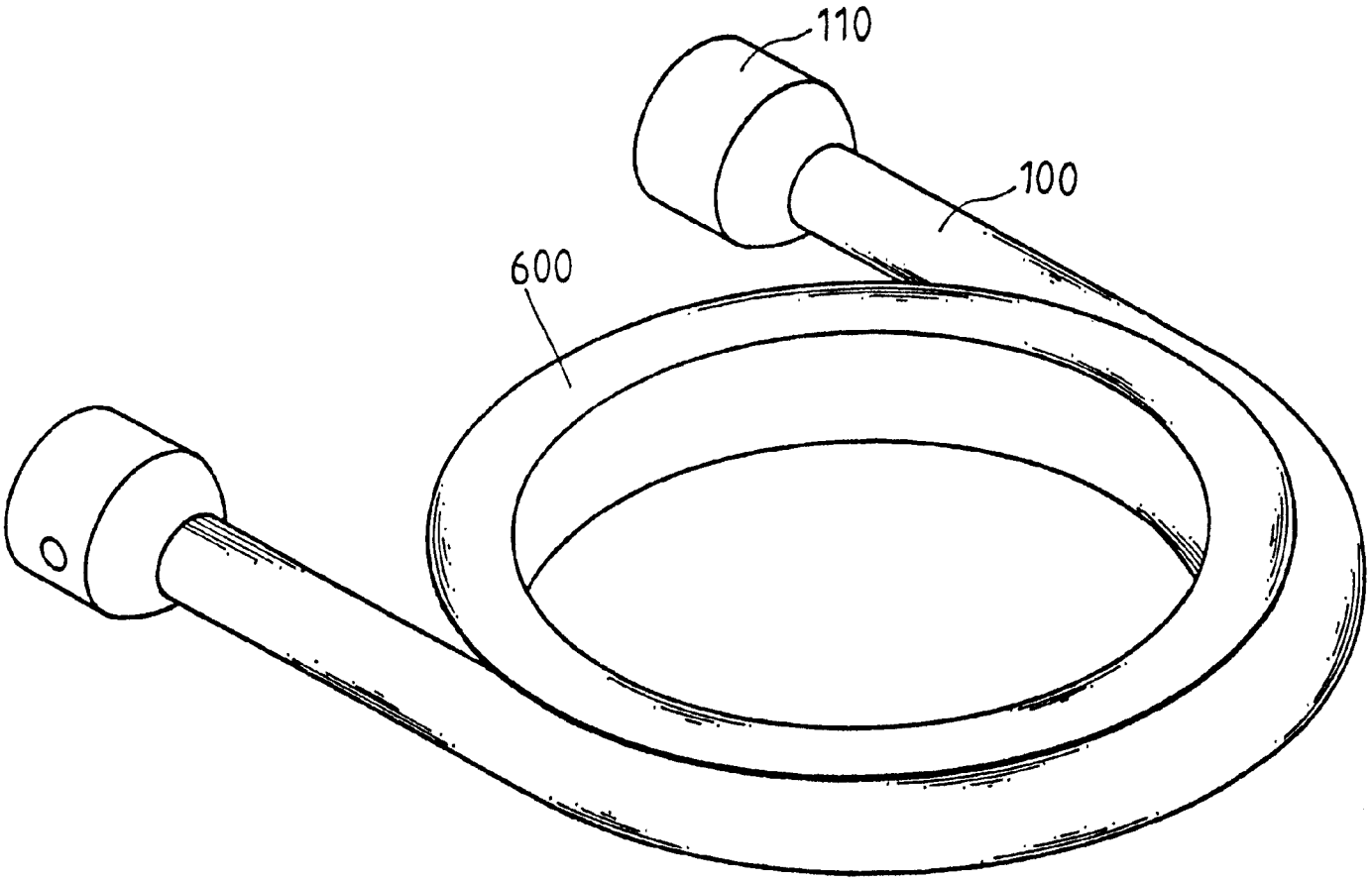
FIG. 7B shows a schematic view of the cup rack of the present invention in combination.

A cup rack of the present invention is shown in FIGS. 7 and is composed of a U-shaped fastening piece 100, two connection heads 110 and a block body 600 which is held between two arms of the U-shaped fastening piece 100 in conjunction with a bolt 610.

The fastening pieces 100 and the connection heads 110 of various bathroom racks of the present invention are similar in construction and can be therefore used interchangeably in conjunction with various block bodies.

What is claimed is:

1. A bathroom rack comprising:

(a) at least one U-shaped fastening piece;

(b) two connecting heads for mounting said U-shaped fastening piece onto a wall;

(c) a short flanged cylinder fixedly attached to an arc portion of said U-shaped fastening piece;

(d) wherein said short flanged cylinder having an open mouth to receiving an object with a cylindrical end.

2. The bathroom rack according to claim 1 wherein said U-shaped fastening piece has a circular cross section.

3. The bathroom rack according to claim 1 wherein said short flanged cylinder has a through hole diametrically penetrating through a center portion of said short flanged cylinder, said U-shaped fastening piece has a threaded portion, and said short flanged cylinder fixedly and concealedly attached to said arc portion of said U-shaped fastening piece by a screw which extends through said through hole of said short flanged cylinder and engages with said threaded portion of said U-shaped fastening piece.

4. The bathroom rack according to claim 1 wherein each of said connection heads is provided with a stepped through hole for fastening said connection head onto said wall by a screw.

5. The bathroom rack according to claim 4 wherein said each of said connection heads is provided with a threaded hole for fastening a respective leg of said U-shaped fastening piece inside said stepped through hole of said connection head.

6. The bathroom rack according to claim 1 which comprises a pair of said U-shaped fastening pieces mounted vertically, and wherein said object being received by said open mouth of said short flanged cylinder is a long bar so that said bathroom rack is utilized as a towel rack.

7. The bathroom rack according to claim 1 wherein said U-shaped fastening piece is disposed vertically, and said object being received by said open mouth is a short bar which penetrates through entire said short flanged cylinder so that said bathroom rack is utilized as a bathrobe rack.

8. The bathroom rack according to claim 1 wherein said U-shaped fastening piece is disposed vertically, and said object being received by said open mouth is a short bar which stops at said short flanged short cylinder so that said bathroom rack is utilized as a toilet paper rack.

9. The bathroom rack according to claim 1 which comprises a pair of said U-shaped fastening pieces mounted horizontally, and wherein said objects being received by said open mouth of said short flanged cylinder has a flat top surface so as to collectively support a panel.

* * * * *